US006926103B1

(12) United States Patent
Roodenburg et al.

(10) Patent No.: US 6,926,103 B1
(45) Date of Patent: Aug. 9, 2005

(54) SPLITTABLE BLOCK ON A DERRICK

(75) Inventors: Joop Roodenburg, Delft (NL); Anne Klaas De Groot, Sugar Land, TX (US)

(73) Assignee: Itrec B.V., (NL)

( * ) Notice: Subject to any disclaimer, the term of this patent is extended or adjusted under 35 U.S.C. 154(b) by 204 days.

(21) Appl. No.: 10/386,804

(22) Filed: Mar. 12, 2003

Related U.S. Application Data

(63) Continuation-in-part of application No. 09/807,078, filed on Jul. 2, 2001, now Pat. No. 6,595,494.

(51) Int. Cl.[7] ..... E21B 19/084

(52) U.S. Cl. ..... 175/203; 175/171; 254/285; 254/387

(58) Field of Search ..... 175/203, 171, 175/27, 24; 254/266, 285, 290, 377, 387

(56) References Cited

U.S. PATENT DOCUMENTS

| | | | | |
|---|---|---|---|---|
| 3,116,793 A | | 1/1964 | McStravick | 166/21 |
| 3,469,820 A | * | 9/1969 | Horton | 254/277 |
| 3,658,298 A | | 4/1972 | Moore | 254/190 |
| 3,714,995 A | | 2/1973 | Hanes | 175/5 |
| 3,791,628 A | | 2/1974 | Burns | 254/172 |
| 3,804,183 A | | 4/1974 | Duncan | 175/5 |
| 3,841,407 A | | 10/1974 | Bozeman | 166/315 |
| 3,917,230 A | | 11/1975 | Barron | 254/173 |
| 4,183,649 A | * | 1/1980 | Hartley | 254/279 |
| 4,249,600 A | | 2/1981 | Bailey | 166/77 |
| 4,277,053 A | * | 7/1981 | Simon | 254/326 |
| 4,336,840 A | | 6/1982 | Bailey | 166/77 |
| 4,423,994 A | | 1/1984 | Schefers | 414/22 |
| 4,515,220 A | | 5/1985 | Sizer | 166/384 |
| 4,570,705 A | | 2/1986 | Walling | 166/77 |
| 4,620,692 A | | 11/1986 | Foreman | 254/277 |
| 4,688,764 A | | 8/1987 | Nayler | 254/277 |
| 4,756,188 A | * | 7/1988 | Fennell | 73/152.49 |
| 4,867,418 A | | 9/1989 | Daniels | 254/277 |
| 5,291,956 A | | 3/1994 | Mueller | 175/67 |
| 5,520,369 A | * | 5/1996 | Chatard | 254/277 |
| 5,671,811 A | | 9/1997 | Head | 166/346 |
| 5,839,514 A | | 11/1998 | Gipson | 166/384 |
| 5,894,895 A | | 4/1999 | Welsh | 175/5 |
| 6,009,216 A | | 12/1999 | Pruett | 385/12 |
| 6,065,540 A | | 5/2000 | Thomeer | 166/297 |

(Continued)

FOREIGN PATENT DOCUMENTS

| | | | |
|---|---|---|---|
| GB | 217194 A | 3/1986 | B66C 13/04 |

*Primary Examiner*—David Bagnell
*Assistant Examiner*—Daniel P Stephenson
(74) *Attorney, Agent, or Firm*—Buskop Law Group, P.C.; Wendy Buskop

(57) ABSTRACT

The invention is a hoist system for a derrick with a derrick inside, a derrick outside, and a derrick top side; a splittable block connected to the derrick top side; a hoisting cable guided through the splittable block; a moveable trolley with a trolley top side and a trolley bottom side, wherein the trolley is connected to the splittable block and wherein the moveable trolley is removably secured on the derrick; and a hoist winch adapted to pull the hoisting cable over the derrick top side and through the splittable block to move the moveable trolley relative to the derrick.

57 Claims, 12 Drawing Sheets

U.S. PATENT DOCUMENTS

| | | | | |
|---|---|---|---|---|
| 6,158,516 | A | 12/2000 | Smith | 166/385 |
| 6,273,188 | B1 | 8/2001 | McCafferty | 166/77.2 |
| 6,361,262 | B1 | 3/2002 | Roodenburg | 414/22.51 |
| 6,431,286 | B1 | 8/2002 | Andreychuk | 166/384 |
| 6,502,541 | B2 | 1/2003 | Abo | 414/22.51 |
| 2003/0010505 | A1 | 1/2003 | Gipson | 166/384 |

* cited by examiner

37

12
32
44
38
42
40
48
46
22
28
64

31
142
19
140
37
18
20
21
10
33
46
48
22
23
110
100
32
PLC
19
14
34
56
26
12

SPLITTABLE BLOCK ON A DERRICK

The present continuation in part application claims priority to application Ser. No. 09/807,078 filed in the U.S. Patent and Trademark Office on Jul. 2, 2001 now U.S. Pat. No. 6,595,494.

FIELD OF THE INVENTION

The present invention relates to a hoist system mounted on a derrick that minimizes the energy consumption and operating cost of lifting operations.

BACKGROUND OF THE INVENTION

Hoist systems in the prior art are used in the offshore industry in the form of drilling derricks on, for example, drilling vessels. When, in use, a drill string is attached to the bottom side of a moveable, also known as a traveling block. The moveable trolley runs on separate tracks inside or outside the derrick.

The problem in the current art is that it is difficult to find an optimum compromise between speed and power in the hoisting systems. The hoisting cable is guided over the cable blocks in the derrick in such a way that several cable parts extend between the derrick and the moveable block. In this case, the more the wire parts are present between the derrick and the moveable block, the greater the load that can be lifted with the hoist system if the hoisting winch remains unchanged. In contrast, the more wire parts present between the derrick and the moveable, the lower the speed at which the moveable can be moved relative to the derrick when the maximal speed of the winch stays the same.

In order to find a good compromise between speed and lifting power, it is generally decided to provide the hoist system with relatively heavy winches. The heavy winches ensure that they will be able to move the move up and down rapidly in every conceivable case. The disadvantage is that a substantial part of the lifting power is not being utilized for a substantial part of the time. In other words, the device is actually provided with a winch that is too heavy—and therefore too expensive—to be able to reach sufficient speed occasionally.

The object of the current invention is to provide a hoisting system that, on one hand, can handle a relatively heavy load and, on the other hand, handle a relatively light load at a relatively high speed. Such a design could be relatively light and cheap design.

The object is achieved in the present invention by guiding the hoisting cable over loose pulleys that can be moved between a first position, in which the loose pulleys are connected to the derrick, and a second position, in which the loose pulleys are connected to the moveable.

The effect of this measure is that the number of wire parts between the derrick and the moveable can be set to optimum number. When loose pulleys are attached to the derrick, few wire parts extend between the derrick and the moveable and, therefore, a relatively low weight can be lifted with a relatively high speed. When loose pulleys are attached to the moveable trolley, a relatively large number of wire parts extend between the derrick and the moveable and, therefore, the moveable trolley can be moved at a relatively low speed relative to the derrick with a relatively large load. Since the hoisting cable is guided over the pulleys, the pulleys can be attached as desired to the derrick or to the moveable. The hoisting cable does not have to be reeved again and the desired number of wire parts can be set in a relatively short time.

According to the current invention, the loose pulleys can be attached symmetrically relative to the center of the derrick. This symmetry ensures that the forces exerted upon the cables are transmitted symmetrically to a derrick. In turn, no additional bending loads are exerted upon the derrick to limit the necessary weight of the derrick.

The loose pulley can also be placed in a housing with locking elements for fixing the pulleys on the moveable. The loose pulleys are pulled automatically into their first position, in contact with the derrick, by tension in the hoisting cable. It is therefore sufficient to provide the bottom side of the pulleys with locking elements.

It is advantageous for the locking elements to be equipped with a hydraulic actuation device. The use of a hydraulic actuation device means that the locking pins can be remotely controlled.

In the devices according to the prior art it is customary for a hoisting cable to be attached to a fixed point at one end. The other end of the hoisting cable is then wound around a hoist winch. If this hoist winch breaks down, it is no longer possible to work with the device. The mentioned hoist winch has also to be of relatively large and costly design to meet with all the required demands. Repeated bending at the same places is a major factor of wear of the cable. To increase the service life of the cable after a known number of lifting cycles the cable is shifted to move the places of repeated bending. In hoist systems known from prior art this is done by a procedure known as the "slip & cut" procedure. This takes considerable time and is not without personal danger.

It is therefore an object of this invention to provide a hoist system by means of which an increased level of redundancy is provided. It is another object of this invention to provide means with which the time consuming and dangerous "slip & cut" procedure can be avoided altogether. An object of this invention is to provide a hoist system with relatively inexpensive winches decreasing the building and operating cost of the hoist system.

It is therefore advantageous for the hoisting means to be provided with two winches, each end of the hoisting cable being wound onto a separate winch. By winding the two ends onto a separate winch, it is possible to achieve the same cable speed at a relatively low speed of revolution of the winches. By using two winches the cable can be shifted automatically a distance from one winch to the other winch replacing the "slip & cut" procedure. This takes considerably less time and can be performed completely automatic reducing the chance of personal injuries.

Moreover, by adding the second winch, redundancy is provided in the system. Should one of the winches fail, then the hoist system is not unusable, but it is possible to continue working with a single winch.

It is advantageous for the winches to be driven by a plurality of relatively small motors. Because of the fact that twice as many sides of the winches can be used to attach the motor on these motors can be relatively small. For example, it is possible to equip the winches on both sides with electric motors that engage with a pinion in a toothed wheel of the winch. First, this has the advantage that such electric motors are commercially available. For the use of the hoist system it is therefore not necessary to develop a special, and therefore expensive, hoisting winch. Secondly, the relatively small motors have a low internal inertia, which means, for example, that when the direction of rotation of the winch is reversed less energy and time are lost during the reversal.

SUMMARY OF THE INVENTION

The invention is a hoist system for a derrick. The hoist has a splittable block connected to the derrick top side, a hoisting cable guided through the splittable block, and a moveable trolley with a trolley top side and a trolley bottom side. The trolley is connected to the splittable block. Also, the trolley is removably secured on the derrick. The hoist system also has a hoist winch adapted to pull the hoisting cable over the derrick top side and through the splittable block to move the moveable trolley relative to the derrick.

The invention is also hoist system for use in casing drilling.

The invention is also a method for quickly modifying a hoist system from heavy load lifting to light load lifting, a method to slip the hoist cable of the hoist system, a method for quickly modifying a hoist system from light load lifting to heavy load lifting, and a method for casing drilling operations using a hoist system.

BRIEF DESCRIPTION OF THE DRAWINGS

The present invention will be described further with reference to the appended drawings, in which.

The present invention is detailed below with reference to the listed FIGS.

DETAILED DESCRIPTION OF THE PREFERRED EMBODIMENTS

Before explaining the present invention in detail, it is to be understood that the invention is not limited to the particular embodiments and that it can be practiced or carried out in various ways.

A novel feature of the invention is that the hoist system can be used to lift a heavy load and then a light load, in sequence, quickly, safely and efficiently. Similarly, the invention can be used to lift a plurality of light loads and then quickly modified to lift a plurality of heavy loads. The modifications can be done quickly, easily, and safely at sea, without the hoist system needing to be returned to land for retrofitting.

Figure 1:
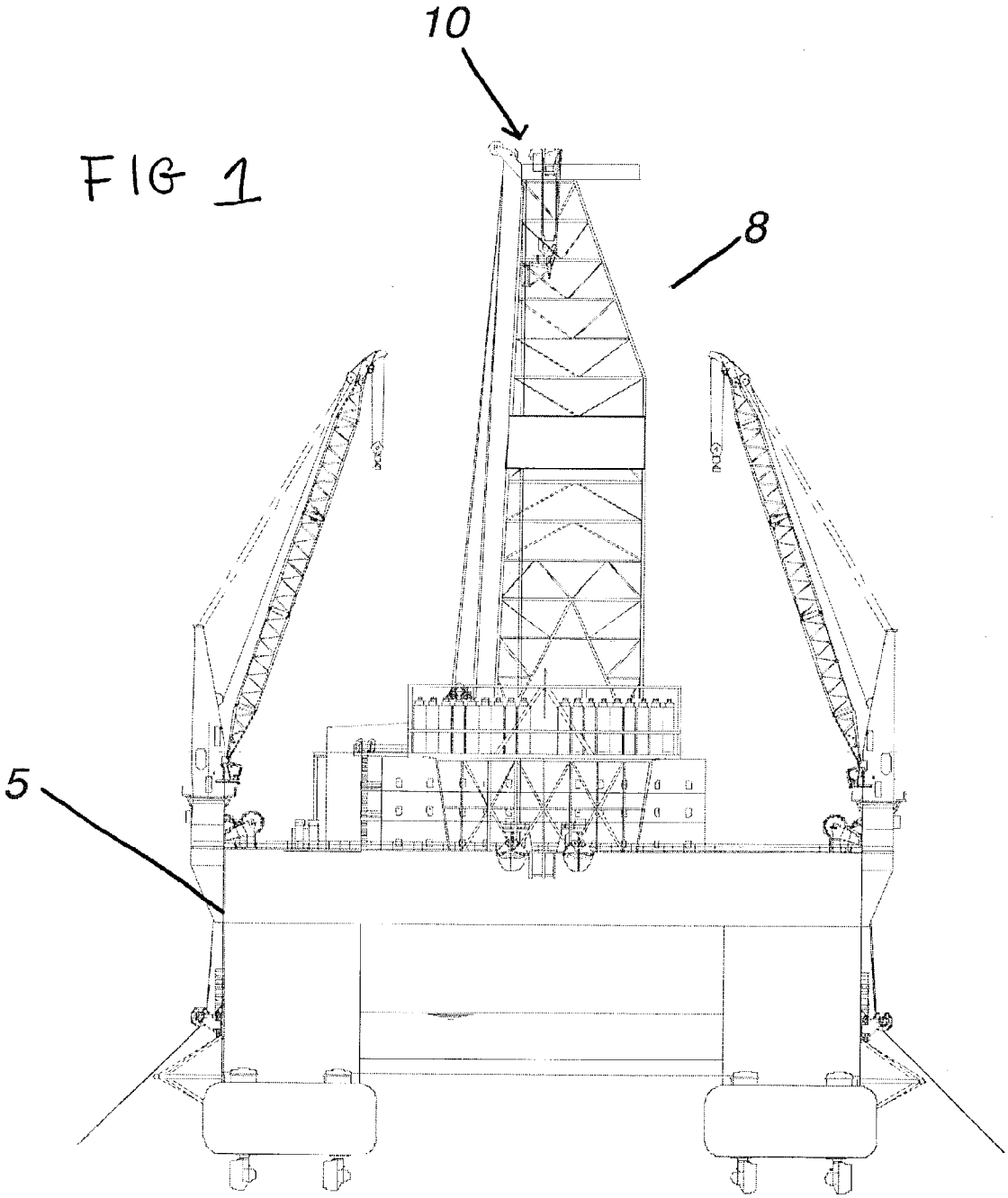
FIG. 1 shows the hoist system according to the present invention located on a drilling platform.

FIG. 1 shows a drilling platform 5, in this case a semi submersible, with a derrick 8 mounted on the drilling platform 5 and hoist system 10 mounted on derrick 8. FIG. 1 also shows the hoisting cable 32 and hoist winch 34

Figure 2:
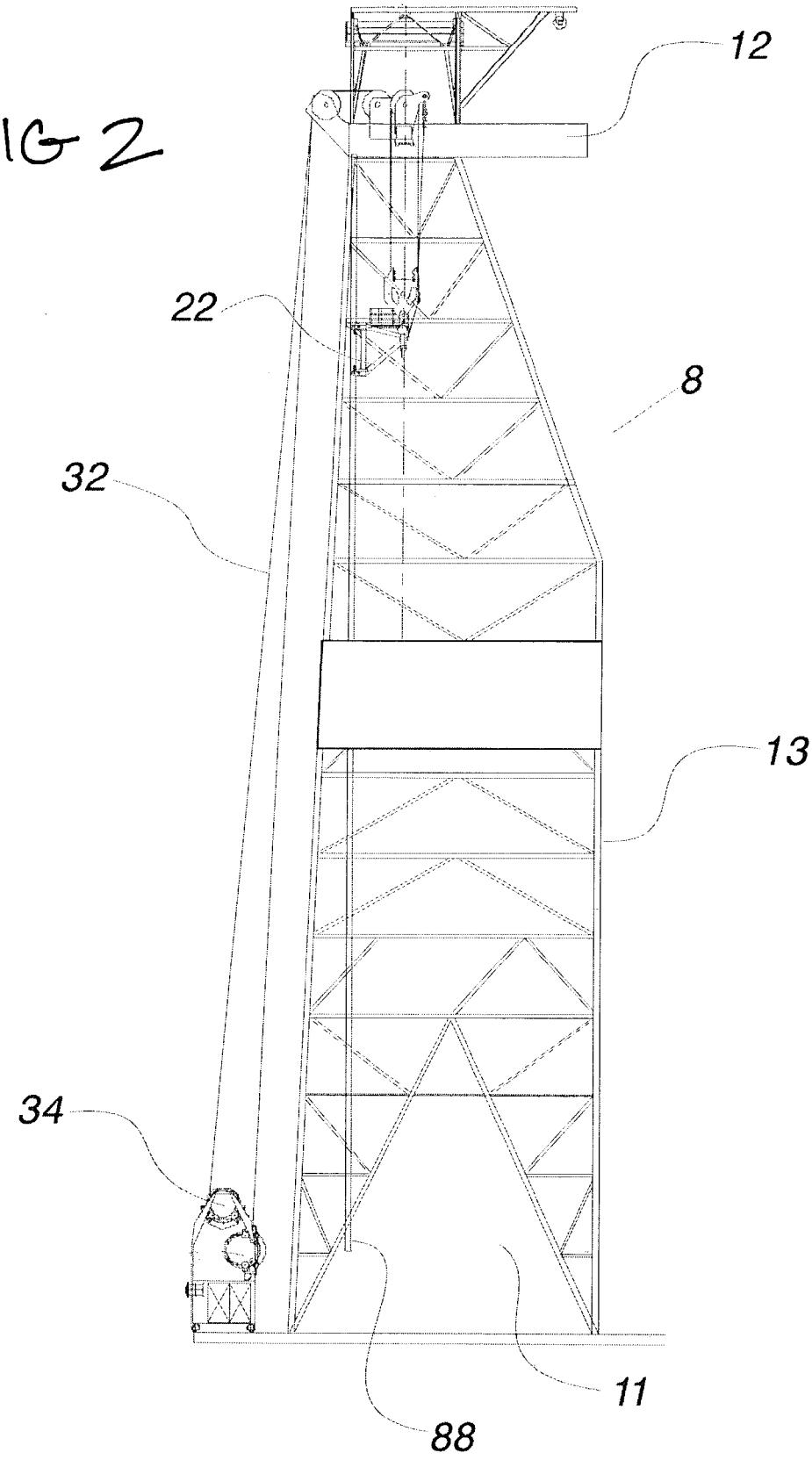
FIG. 2 shows a side view of a derrick with the hoisting system mounted thereon

FIG. 2 shows a derrick 8 with the hoisting system 10 mounted thereon. Visible is a derrick 8 with a derrick topside 12, a derrick inside 11 and a derrick outside 13. On derrick topside 12 is the splittable block 20 mounted. Furthermore rail 88 is mounted on the inside of the derrick 11. A trolley 22 can be seen removably mounted on rails 88, 90. Rail 90 is not visible in this drawing.

Figure 3:
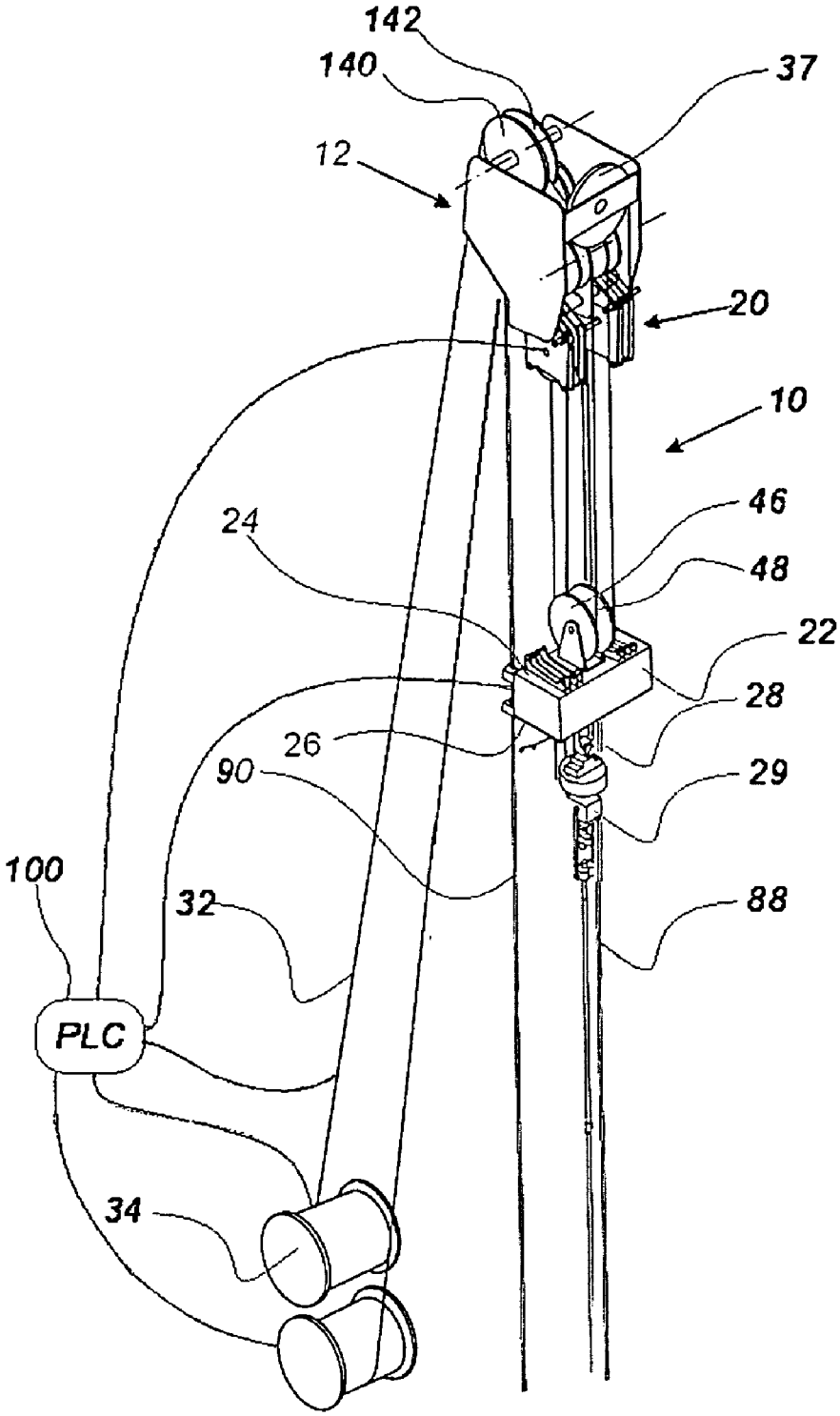
FIG. 3 shows a perspective view of the hoist system with the derrick not shown.

FIG. 3 shows the hoist system 10 according to the present invention. The hoist system 10 comprises a derrick that is not drawn in this figure for clarity. In the description below the term derrick will always be used, but it must be understood that any other suitable device, such as, for example, a tower or a mast, could also be used.

The top side of the derrick is formed by a derrick topside 12. A large number of cable pulleys are fixed to the topside 12 of which only pulley 140 is visible.

Furthermore, a return fixed pulley 37 is fixed on the derrick topside 12, the axis of the fixed return pulley 37 being substantially perpendicular to the axis of the loose and fixed pulleys 38, 40, 42, 44, 46 and 48. Said loose pulleys are shown in more detail in FIG. 4. Also return pulleys 140, 142 can be seen which guide the hoist wire 32 from the derrick topside 12 to winches 34, 56.

The hoist system 10 further comprises a trolley 22. This trolley 22 can move along a guide in the form of rails 88, 90, relative to the derrick 8. Trolley 22 comprises a trolley top side 24 and a trolley bottom side 26. On the trolley bottom side 26, trolley 22 is provided with a gripper or hook 28, or some other suitable means, to which a load to be hoisted can be attached. FIG. 3 shows the case in which a top drive 29 with a drill string 26 fixed below it is attached to the gripper 28. On the trolley top side 24, trolley 22 is provided with two fixed cable pulleys 46, 48. The trolley top side 24 is connected to the splittable block 20 by means of hoist cable 32 which runs over return pulleys 140, 142 to the splittable block pulleys and the pulleys 46, 48 located on the trolley topside 24. Trolley 22 is removably secured on the derrick 12. The system can be controlled by a PLC or control system 100.

Figure 4:
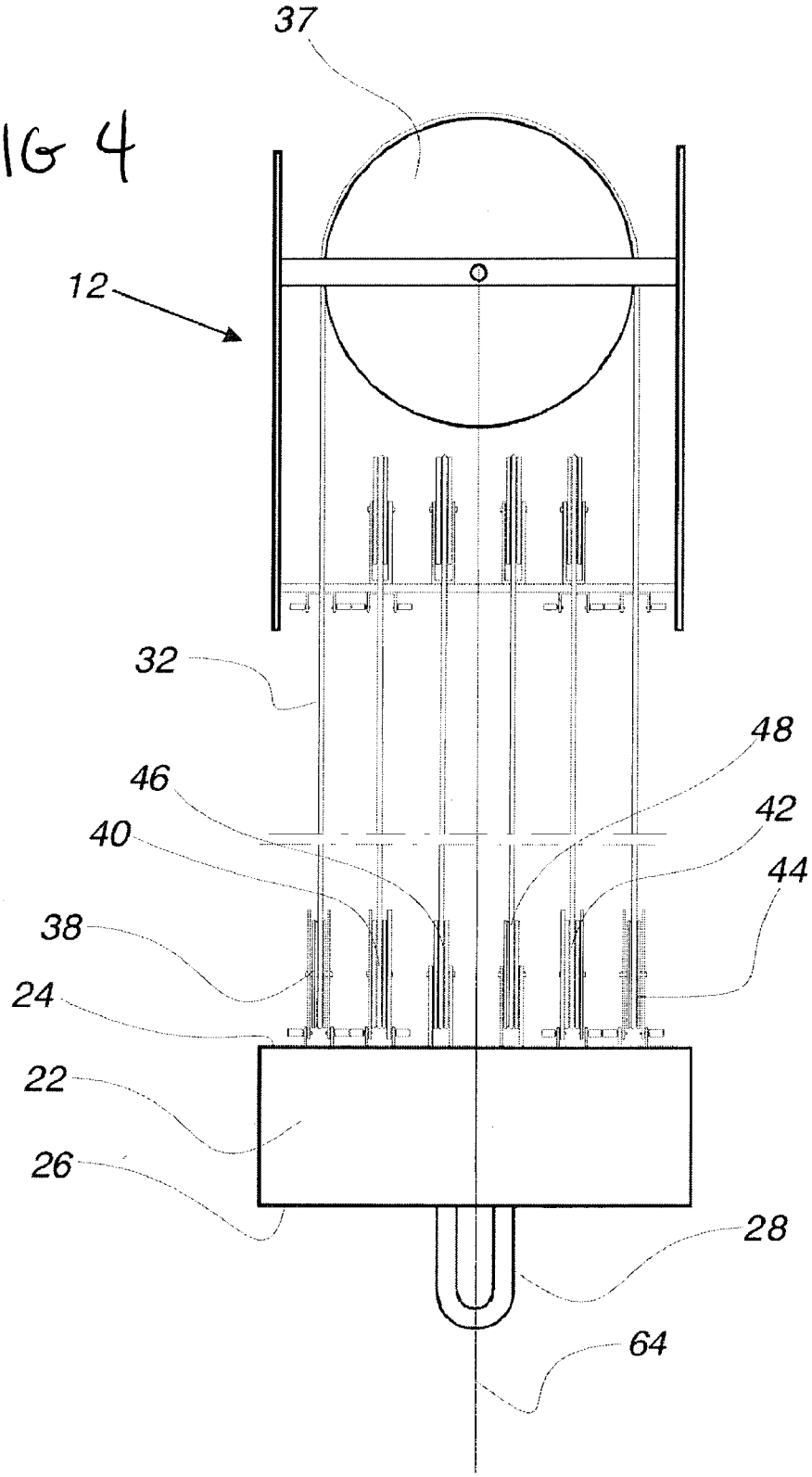
FIG. 4 shows the case where four loose pulleys are attached to the moveable.

In FIG. 4, in addition to the above mentioned cable pulleys 140, 142 four "loose pulleys" 38, 40, 42, 44 are also present in the hoist system 10. Also visible are fixed masthead pulleys 160, 162, 164, 166. The central axis is reference numeral 64.

Returning to FIG. 3 these loose pulleys 38, 40, 42, 44 may be attached as desired to the derrick top side 12 or to the trolley 22. The coupling of the loose pulleys 38, 40, 42, 44 to the derrick top side 12 or to the trolley 22 is shown in detail in FIG. 7 through FIG. 10.

The advantage of the presence of the loose pulleys 38, 40, 42, 44 is that the number of wire parts of the hoist cable 32 that extend between the derrick top side 12 and the trolley 22 can be varied. If the loose pulleys 38, 40, 42, 44 are attached to the derrick top side 12, a limited number of wire parts will extend in the direction of the trolley 22. That means that, on the one hand, a relatively limited weight can be lifted with the aid of the hoist system, but, on the other hand, the trolley 22 can be moved relatively quickly in the direction of the derrick top side 12. If the loose pulleys 38, 40, 42, 44 are attached to the trolley 22, a relatively large number of wire parts will extend from the derrick top side 12 in the direction of the trolley 22. That means that a relatively great weight can be lifted with the aid of the trolley 22, but that the trolley 22 will be moved at a relatively slow speed relative to the derrick top side 12 with unchanged maximal winch speed. By distributing the number of loose pulleys 38, 40, 42, 44 as desired over the derrick top side 18 and the trolley 22, it is ensured that both the weight to be lifted with the hoist system and the speed at which the trolley 22 can be moved relative to the derrick top side 12 are adjustable.

In the prior art a known problem is that a hoist system often has to be equipped with a relatively large drive, in order to be able to achieve a workable compromise between the maximum lifting power and the minimum speed to be achieved. This problem is solved by the "loose pulleys" according to the present invention. The combination of loose pulleys is called "splittable blocks".

In the hoist system 10 according to FIG. 3 the hoist cable 32 extends from a first hoist cable winch 34 in the direction of the derrick top side 12. The hoisting winch is also known as a "draw works". The hoisting hoist cable 32 is subsequently guided back to a second hoisting winch 56. In the prior art, it is customary for an end section of the hoisting hoist cable 32 to be fixed at a fixed point, the other end being rolled up on a hoisting winch. Several advantages can be obtained by making use of two hoisting winches 34, 56, as an alternative to using one winch as in the hoist system 10. In order to achieve a certain speed of trolley 22 relative to derrick top side 12, the speed of rotation of the hoisting winches 34, 56 can be kept twice as low compared to using one hoisting winch. One of the effects that can be obtained by keeping the speed of the hoisting winches 34, 56 relatively low is that little wear will occur in the hoist cable 32.

Another advantage of using two winches is that the manual "slip & cut" procedure according to prior art is now no longer needed. The "slip & cut" procedure is needed to increase the service life of the hoisting cable. The procedure takes a considerably amount of time since it has to be done very regularly, manually and it not without danger. Also by using two winches the redundancy of the hoist system is increased. Should one of the two hoisting winches fail during use, work can continue using another hoisting winch. In the prior art the failure of a hoisting winch immediately means that the hoist system can no longer be used.

The hoisting winches 34, 56 are preferably driven by electric motors 58, 60. When using two winches each side of each hoisting winch for example, 34, 56 can be provided with such a motor doubling the number of sides to which a motor can be attached. That means each hoisting winch is driven by 2 electric motors. First, this has the advantage that the electric motors to be used can be kept relatively small, which means that these motors do not have to be designed specifically for the hoisting purposes, but will be in stock on the market. This in contrast to designs that are currently on the market which use large, custom made and therefore expensive motors. Secondly, the use of the relatively small motors has the effect that the internal inertia in the motors is kept low. That means that when the direction of rotation of the winches 34, 56 is reversed the internal inertia of the drive elements themselves will not give rise to problems. This is especially an advantage when using the hoist system on a drilling rig and operating in the so called "active heave compensation" mode. In this mode the winches are used to compensate for the movement of the rig by continuously paying out or in cable.

The hoist system 10 according to the present invention can advantageously be used for numerous hoisting operations. The hoist system 10 is particularly advantageous when used in the case of drilling operations, from a vessel. The reason for this is that, particularly in the case of such drilling operations, in some parts of the drilling processes has to be possible for a very great hoisting force to be applied, and that in other parts of the drilling process the speed at which the trolley can move relative to the mast in the most important factor.

The derrick has dimensions of a height between 30 feet and 240 feet and a width between 3 and 90 feet. The derrick can also be secured to a floating vessel or a platform.

The derrick has a central axis 64 and the loose pulleys 38, 40, 42, 44 are attached symmetrically on the derrick 8 relative to the central axis 64.

The hoist cable has a diameter ranging between 0.5 inches and 3 inches and is adapted to support a load of between 1 metric tons and 400 metric tons. The system can further include a control system for monitoring and driving the hoist cable, the winch, the splittable block, and the trolley.

FIG. 4 illustrates the case where four loose pulleys 38, 40, 42, 44 are attached to the trolley 10. It can be seen in FIG. 4 that four loose pulleys 38, 40, 42, 44 and two fixed pulleys 46, 48 are attached to the trolley 22. This means that twelve wire parts extend between the trolley 22 and the derrick top side 12.

Figure 5:
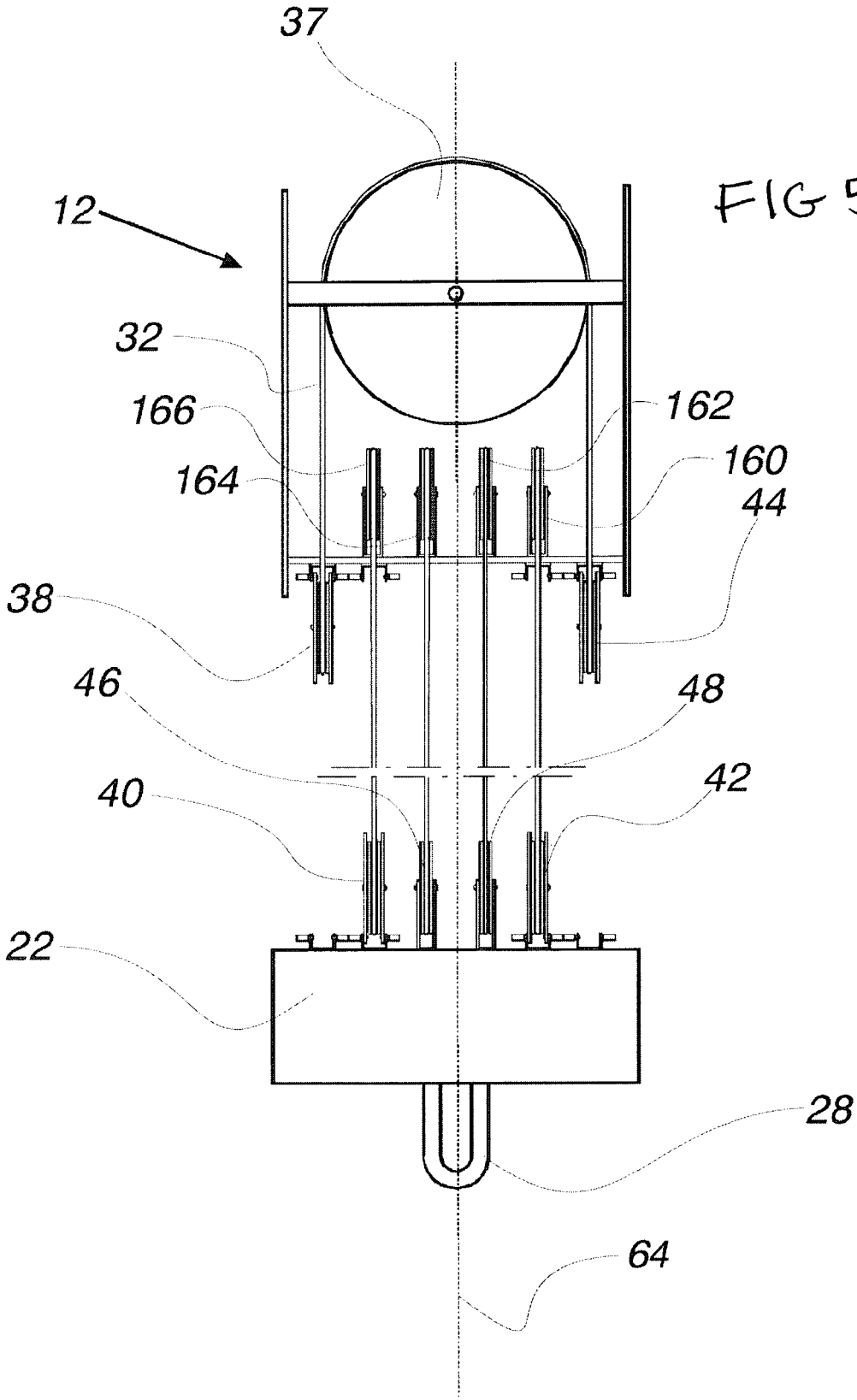
FIG. 5 shows the case where two loose pulleys are attached to the moveable and two loose pulleys are attached to the top side of the derrick.

FIG. 5 shows the case where two loose pulleys 38, 42 and are attached to the derrick top side 12 and two loose pulleys 40, 44 and two fixed pulleys 46, 48 are attached to the trolley 22. In this case eight wire parts will extend between the derrick top side 18 and the trolley 22. two of the fixed pulleys 166 164 are also shown in FIG. 5.

Figure 6:
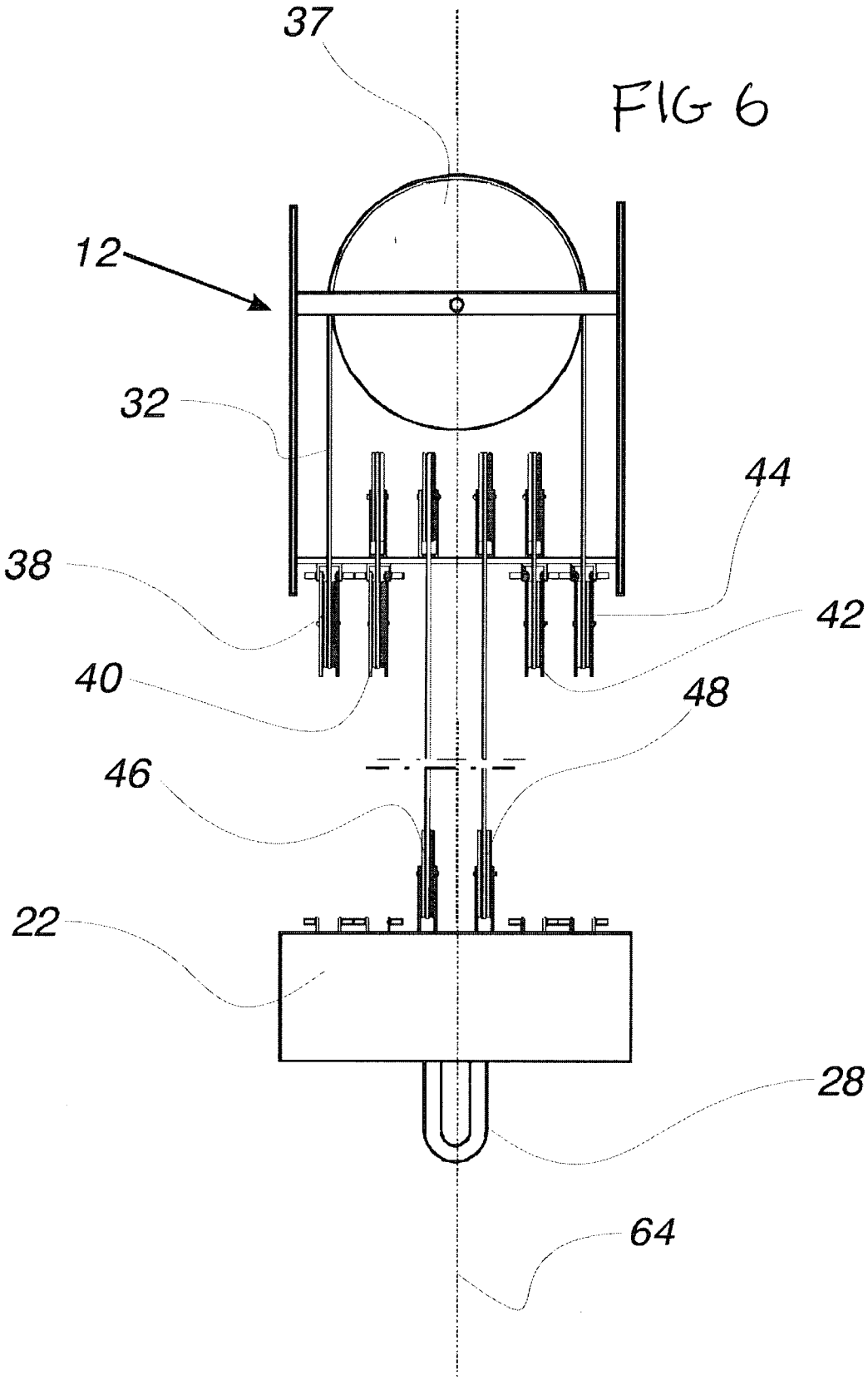
FIG. 6 shows the case where four loose pulleys are attached to the top side of the derrick.

FIG. 6 shows the case where four loose pulleys 38, 40, 42, 44 are attached to the derrick top side 12 and only two fixed pulleys 46, 48 are attached to trolley 22. That means that only 4 wire parts will extend between the derrick top side 12 and the trolley 22. As will be understood, the highest weight can be lifted in the configuration according to FIG. 4, since in that case twelve wire parts extend between the derrick top side 12 and the trolley 22. In the configuration according to FIG. 5 relatively little weight can be lifted since only four wire parts extend between the derrick top side 12 and the trolley 22. However, now the trolley 22 can be moved at a relatively high speed relative to the derrick top side 12.

Figure 9:
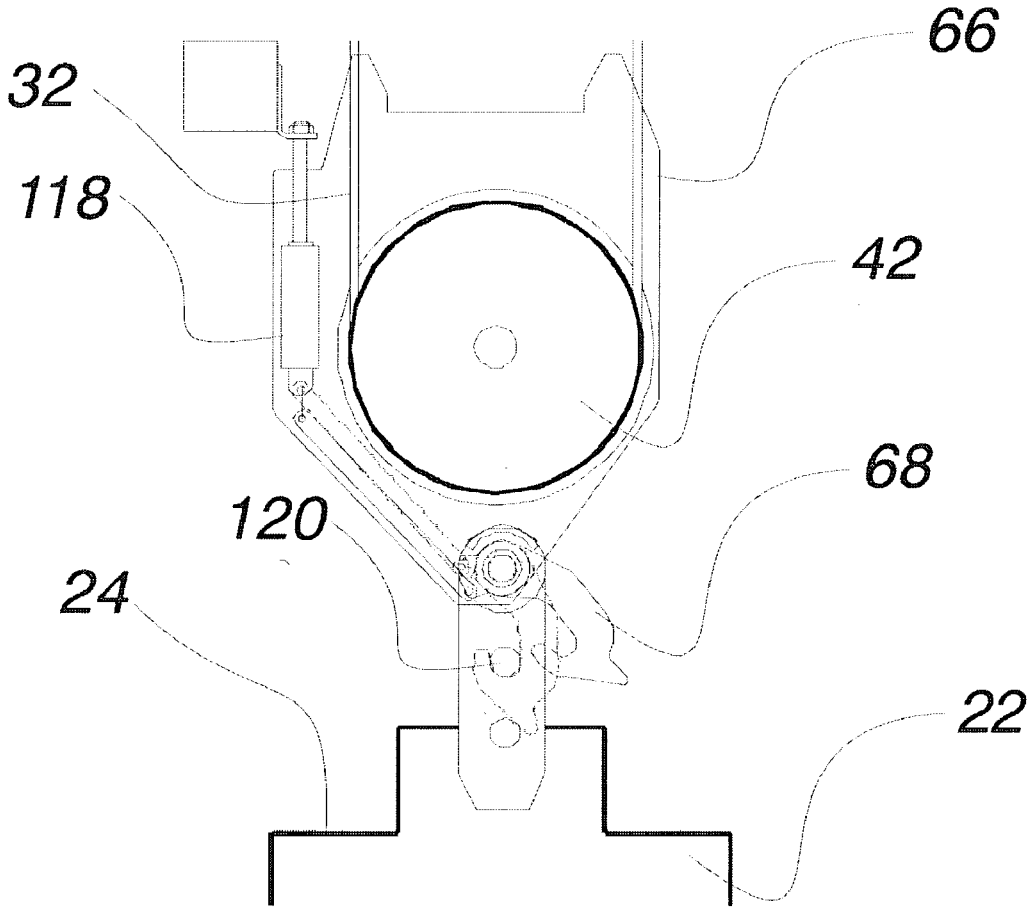
FIG. 9 shows a side view of one of the loose pulleys according to FIG. 7.

The loose pulleys 38, 40, 42, 44 can each be contained in a housing 66 as is shown in FIG. 9. Each housing 66 can further include at least one locking element for attaching the loose pulleys on the trolley 22 and one derrick locking element 82. A hydraulic actuation device 118 can be used for the at least one trolley locking element 68, 70, 72 and 74. The locking elements can be a hook or a pin.

It can be seen in FIGS. 4, 5 and 6 that on the left-hand side of the derrick 8 exactly the same number of loose pulleys 38, 40, 42, 44 are attached to the derrick top side 12 as on the right-hand side. That means that the forces of the hoist cable 32 on the derrick will be distributed symmetrically.

Figure 7:
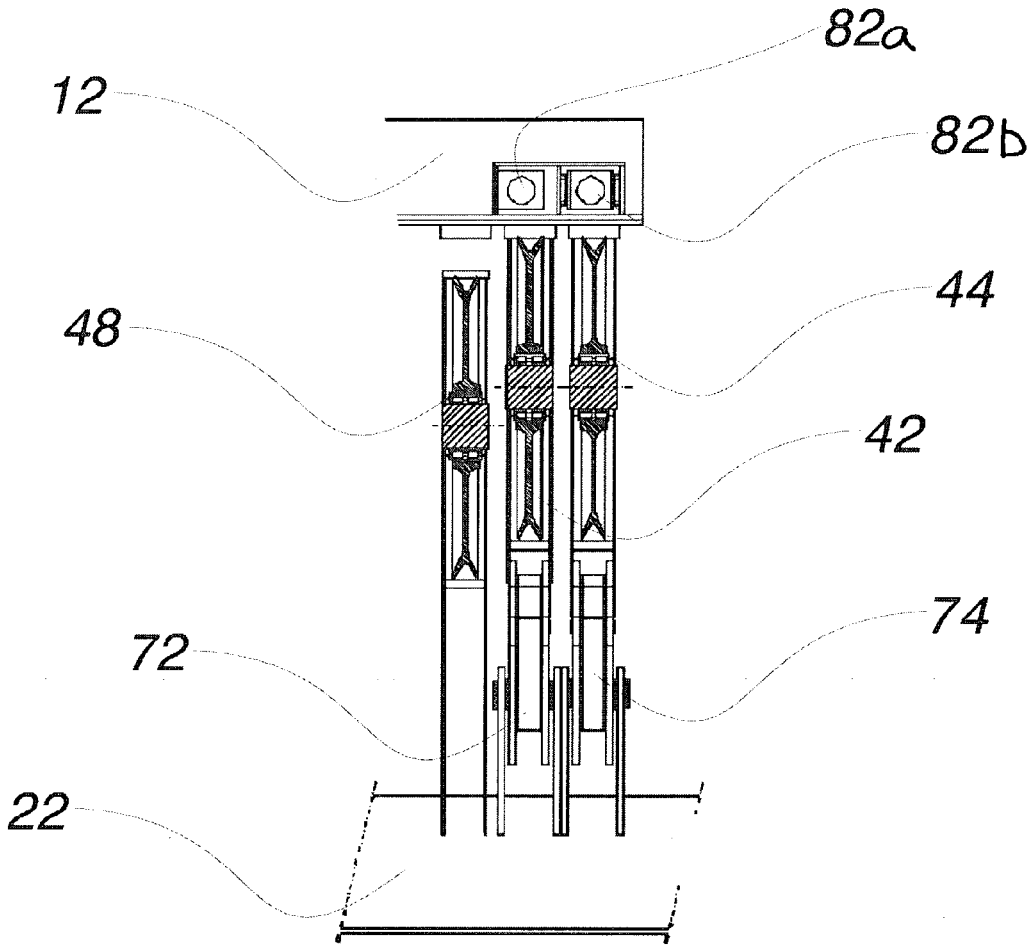
FIG. 7 shows a front view of a possible embodiment of the loose pulleys.

FIG. 7 shows a front view of a part of the trolley 22, with a fixed pulley 48 and loose pulleys 42, 44 thereon. The block will be designed symmetrically, with loose pulleys 42, 44 being placed on both sides of the fixed pulley 48. On the bottom side, the loose pulleys 42, 44 are provided with trolley locking devices 72, 74. The pulleys 46, 48 can be fixed on the trolley as desired. Since there will always be a certain tension on the hoisting hoist cable 32, the loose pulleys 38, 40, 42, 44 are pulled automatically in the direction of the derrick top side 12. For that reason, locking means can be dispensed on the top side of the pulleys 38, 40, 42, 44. However, if the tension is lost completely, pulleys 38, 40, 42, 44 will fall downwards by the force of gravity. In order to be on the safe side, the hoist system is therefore provided with a derrick locking device 82*a*, 82*b* that can be as designed in, for example, FIG. 8.

Figure 8:
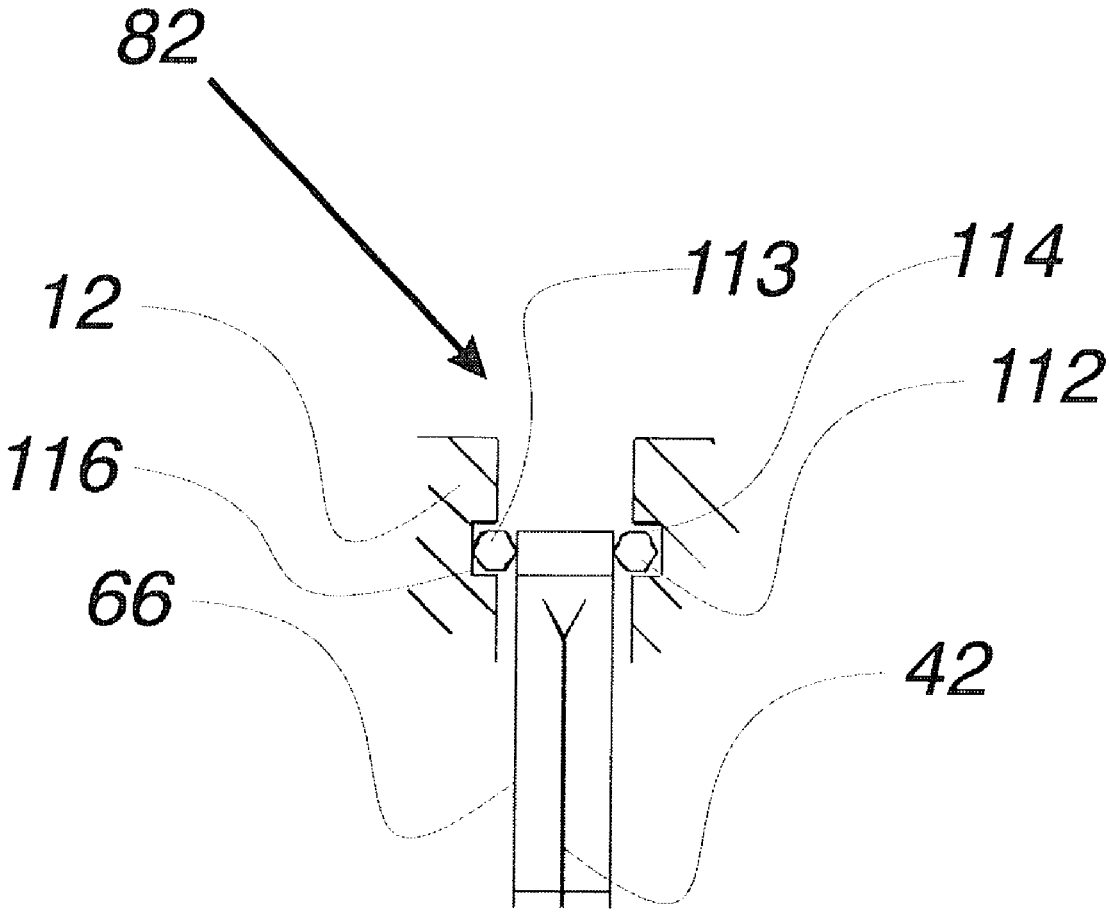
FIG. 8 shows a detailed view of a possible method of connecting the loose pulley to the top side of the derrick.

According to FIG. 8, a pulley 42 is provided on its top side with two balls 112, 113 that are connected to the housing 66 of the pulley 42 in such a way that they are movably relative to each other. The balls are accommodated in recesses 114 and 116 in the derrick top side 18. If no force at all is exerted upon the pulley 42, the force with which the balls lock the pulley in the derrick top side is sufficient to hold the pulley 42 in place. However, if a slight force is exerted upon the pulley, the balls are released from the recesses, and the pulley 42 can move downwards. This system can be applied on each separate loose pulley.

FIG. 9 shows the moveable loose pulley 42 in the housing 66. The lock 68 is shown in two positions. The cylinder 118 by means of which the lock 120 is operated has been deliberately placed in the mast top side 18. The fact is that the trolley 22 goes into hazardous zone areas on a drilling platform or vessel. During the drilling, gas or oil can escape in this area. Non-explosive equipment must be worked with in the Hazardous Area. For that reason, the advantage of the placing the cylinder 120 on or in the trolley topside 24 is that, in most cases, the trolley will be well outside the hazardous zone areas.

The position of the lock 68 is determined with the aid of a cylinder 118. When the cylinder is not actuated, the lock falls behind the pin 120. The pulley 42 is thus connected to the trolley 22. When the trolley 22 during use is moved relative to the derrick top side 12, the trolley 22 takes that loose pulley 42 along with it downwards. If, on the other hand, the cylinder 118 is actuated, the hook cannot grip behind the pin 120 and that means that the trolley 22 cannot take the pulley 42 along with it, so that the pulley 42 remains behind in the derrick top side 12.

Figure 10:
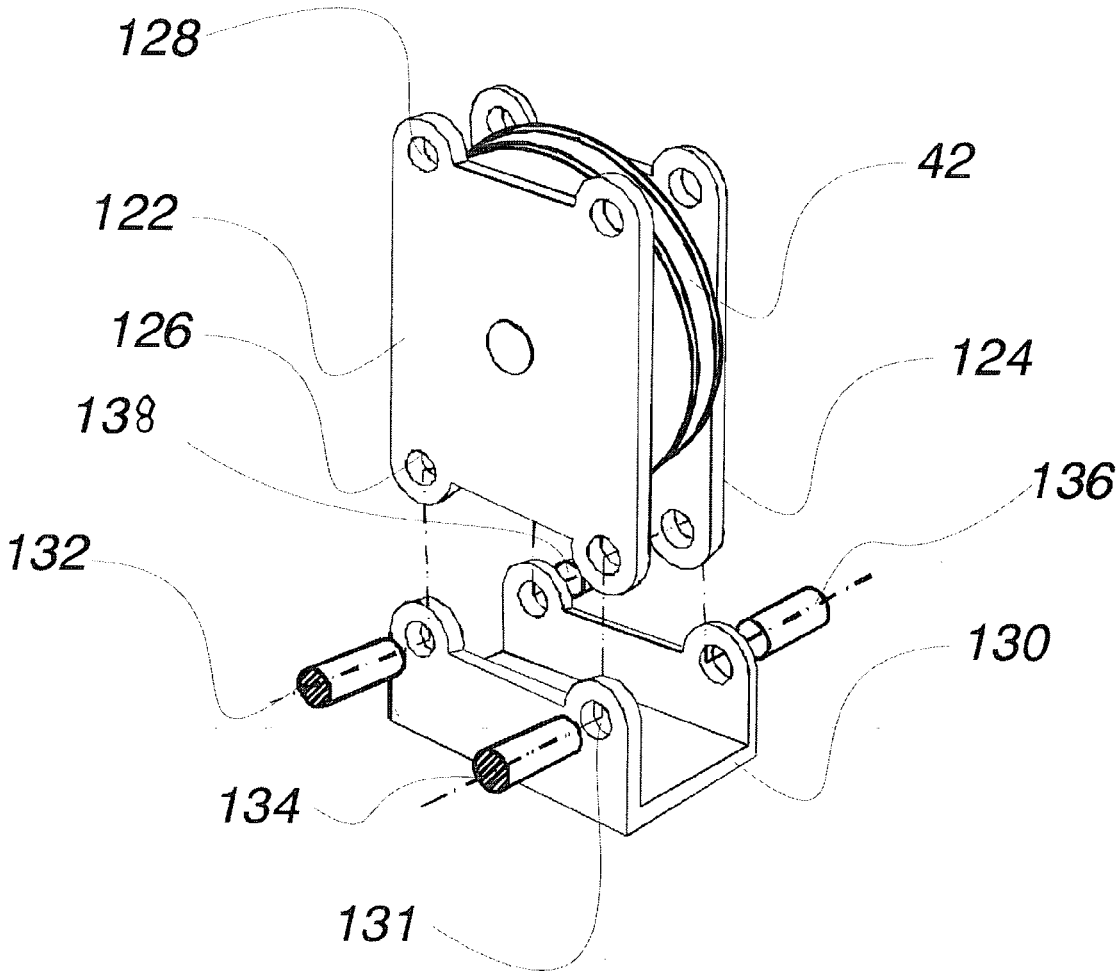
FIG. 10 shows a second embodiment of loose pulley.

FIG. 10 shows a further embodiment of the loose pulleys 38, 40, 42, 44 the loose pulley 42 comprises an outer housing consisting of two plates 122, 124. On the bottom side, these plates 122, 124 are provided with eyes 126, in which locking pins 132, 134, 136, 138 are received. On the top side similar locking pins move through eyes 128. The locking pins on the bottom side move through eyes 131 which are cut out in, for example, a U-shaped fastening element 130. This fastening element 130 can be attached either to the trolley or to a mast head. In use, the trolley 22 will be hoisted to a position as close as possible to the derrick top side 12. After that, either the locking pins 132, 134, 136, 138 belonging to the trolley 22 or the locking pins belonging to the derrick top side 12 will be moved into the eyes 126, 128 of the plates 122, 124. In this way a choice can be made concerning which loose pulleys 38, 40, 42, 44 are connected to the derrick top side 12 and which loose pulleys 38, 40, 42, 44 are connected to the trolley 22.

Figure 11:
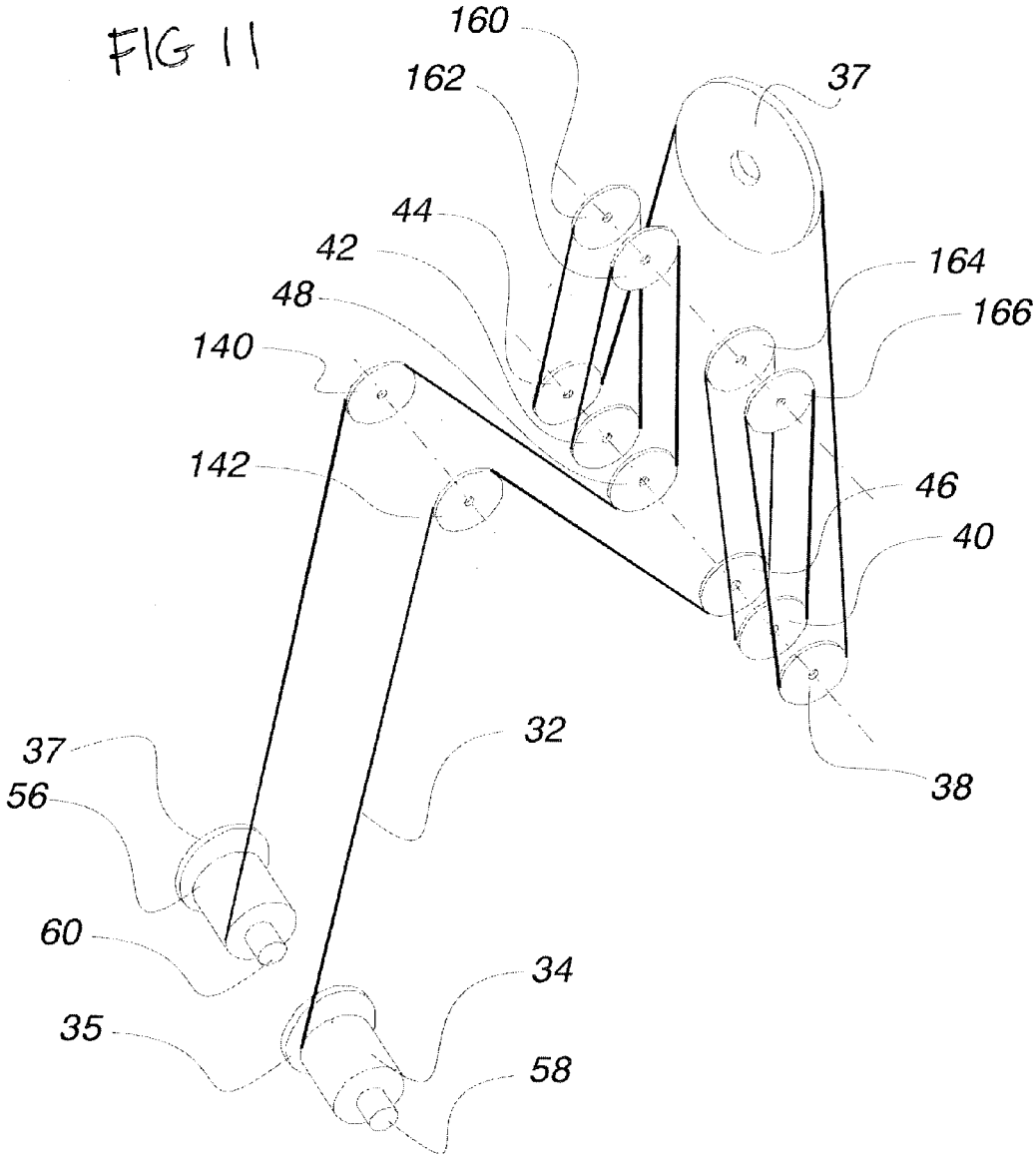
FIG. 11 shows diagrammatically the run of the hoisting cable over the various pulleys, in the case where four loose pulleys are attached to the moveable.

FIG. 11 shows the run of the hoist cable 32 from the hoist cable winch 34 over the successive fixed cable pulleys and loose pulleys on the derrick topside and splittable block in the direction of the hoisting winch 56. FIG. 10 shows the case where the four loose pulleys 38, 40, 42, 44 lie substantially in line with the two pulleys 46, 48 which are immovably fixed to the trolley 22. That means that in the case shown in FIG. 11 twelve wire parts will extend between the derrick top side 18 and the trolley 10. The hoist system can further include brakes 35, 37 on each winch.

The hoisting cable has a first end and a second end and the first end is wound on the winch and the second end is wound on a second winch. The winch and the second winch are each driven by at least one motor with a low inertia.

FIG. 11 shows a reeving plan for the hoisting cable 24 that can be used for the device according to the invention with heave compensators added to the system.

Figure 12:
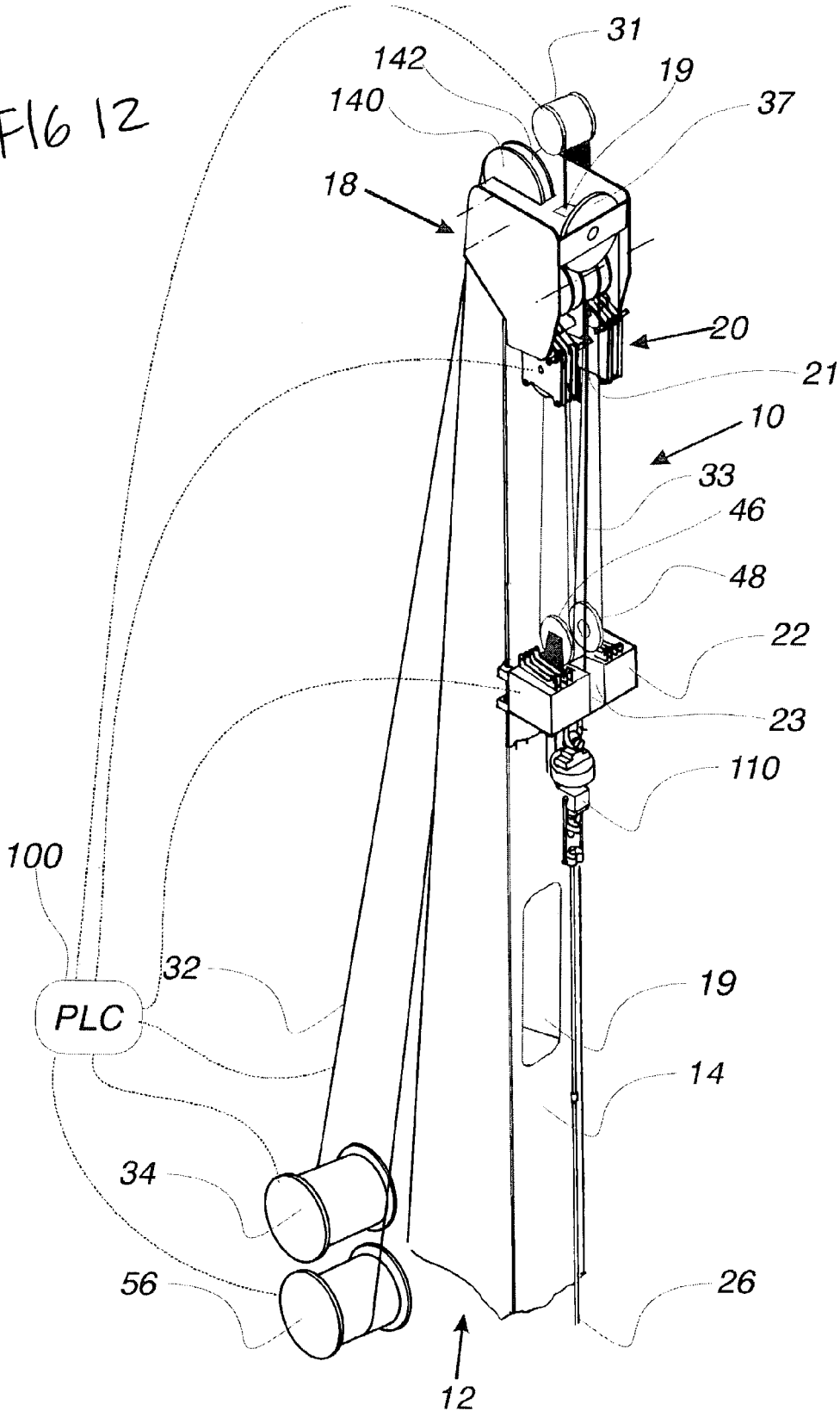
FIG. 12 shows diagrammatically a second possibility for reeving the hoisting cable when a compensator system is installed on the hoisting device.

FIG. 12 shows the hoist system 10 according to the present invention adapted for casing drilling. The hoist system 10 comprises a derrick 8 provided with a derrick topside 12, a derrick inside 11 and a derrick outside 13, a splittable block 20 connected to the derrick topside 12, a trolley 22 connected to the derrick comprising a trolley topside 24 and a trolley bottom side 26. Trolley 22 is connected to the hoist cable winch 34 by hoist wire 32 passing through the splittable block 20 connected to the trolley and the derrick topside 12. Hoist cable 32 is connected on a first end hoist cable 52 to the hoist cable winch 34 and one the second end can be attached to a fixed point. To adapt the hoist system for casing drilling operations derrick topside is provided with mast opening 19. Opening 19 lying substantially around firing-line axis 13. Splittable block 20 is also provided with a splittable opening 21 which is aligned with mast opening 19. Trolley 10 is provided with trolley opening 23 which is aligned with splittable block opening 21. Running through the openings 19, 21 and 23 is wireline 33. Wireline cable is connected to the wire winch 31 at a wireline first end 53 and on the other end to casing drilling equipment 110.

The trolley has a base supported by a plurality of wheels for slidingly engaging the derrick.

The system can also include numerous rails disposed on the derrick outside. The trolley can then be adapted to engage the rails for lateral movement along the derrick.

The gripper, which can also be a hook, can be adapted to support between 10 metric tons and 1000 metric tons.

The invention is also a method for quickly modifying a hoist system from heavy load lifting to light load lifting. The method uses the hoist system of this invention. The method entails disconnecting the heavy load from the gripper, hoisting the trolley to a first position on the derrick and disengaging a portion of the loose pulleys from the trolley. The method ends by picking up a lighter load and resuming the hoist system operation.

The above method can also include the step of locking the disengaged loose pulleys to the derrick mast after disengaging a portion of the loose pulleys from the trolley.

The invention is also a method to slip the hoist cable of the hoist system. The method involves stopping the hoist system lifting operations, paying out the hoist cable with the winch, winding the hoist cable with the second winch, thereby transferring the hoist cable from the winch to the second winch, and restarting hoist system lifting operations. The method can also include the step of initiating the paying out step when a preset number of bending reversals for the hoist cable is reached in a particular segment of the hoist cable.

The invention is also a method for quickly modifying a hoist system from light load lifting to heavy load lifting. The method uses the hoist system of this invention. The method entails disconnecting the light load from the gripper, hoisting the trolley to a first position on the derrick and disengaging a portion of the loose pulleys from the trolley. The method ends by picking up a heavier load and resuming the hoist system operation.

While this invention has been described with emphasis on the preferred embodiments, it should be understood that within the scope of the appended claims, the invention might be practiced other than as specifically described herein.

While this invention has been described with emphasis on the preferred embodiments, it should be understood that within the scope of the appended claims, the invention might be practiced other than as specifically described herein.

What is claimed is:

1. A hoist system comprising a. a derrick comprising
   i. a derrick inside;
   ii. a derrick outside; and
   iii. a derrick top side;

b. a splittable block connected to the derrick top side; wherein the splittable block comprises a plurality of moveable loose pulleys secured to either the movable trolley or the derrick and a plurality of fixed pulleys secured to the derrick;

c. a hoisting cable guided through the splittable block;

d. a moveable trolley comprising a trolley top side and a trolley bottom side, wherein the trolley is connected to the splittable block and wherein the moveable trolley is removably secured on the derrick; and e. a hoist winch adapted to pull the hoisting cable over the derrick top side and through the splittable block to move the moveable trolley relative to the derrick.

2. The hoist system of claim 1, wherein the derrick is secured to a floating vessel.

3. The hoist system of claim 1, wherein the derrick is located on land.

4. The hoist system of claim 1, wherein the derrick is secured to a fixed leg drilling platform.

5. The hoist system of claim 1, wherein the derrick is secured to a jack up platform.

6. The hoist system of claim 1, wherein the derrick is secured to a cantilever.

7. The hoist system of claim 1, wherein the hoisting cable comprises a first end and a second end and wherein the first end is wound on the hoist winch and the second end is wound on a second winch.

8. The hoist system according to claim 7, wherein the hoist winch and the second winch are each driven by at least one motor.

9. The hoist system of claim 7, further comprising a first brake on said hoist winch and a second brake on said second winch.

10. The hoist system of claim 7, further comprising a control system for monitoring and driving the hoisting cable, the hoist winch, the second winch, the splittable block, and the moveable trolley.

11. The hoist system of claim 1, wherein at least one loose pulley is movable between a first position, in which the loose pulley is connected to the derrick, and a second position, in which the loose pulley is connected to the movable trolley.

12. The hoist system of claim 1, further comprising a housing for containing the loose pulleys.

13. The hoist system of claim 1, further comprising at least one locking element for attaching the loose pulleys on the moveable trolley.

14. The hoist system of claim 13, further comprising a hydraulic actuation device for the at least one locking element.

15. The hoist system of claim 1, wherein the derrick has a height between 30 feet and 240 feet.

16. The hoist system of claim 1, wherein the derrick has a width between 3 feet and 90 feet and a length between 3 feet and 90 feet.

17. The hoist system of claim 1, further rail and a second rail disposed on the derrick and the moveable trolley is adapted to engaged the rails for movement along the axis of the derrick.

18. The hoist system of claim 17, wherein the plurality of rails are disposed on the outside of the derrick and the moveable trolley is adapted to engage the rails for movement along the axis of the derrick.

19. The hoist system of claim 1 wherein a gripper is connected to the trolley bottom side for gripping a load.

20. The hoist system of claim 1, comprising between two loose pulleys and sixteen loose pulleys.

21. The hoist system of claim 1, comprising between two fixed pulleys and eight fixed pulleys.

22. The hoist system of claim 1, wherein the gripper is adapted to support between 10 metric tons and 1000 metric tons.

23. The hoist system of claim 1, wherein the hoist cable has a diameter ranging between 0.5 inches and 3 inches and is adapted to support a load of between 1 metric tons and 400 metric tons.

24. The hoist system of claim 23, wherein the gripper is a hook.

25. The hoist system of claim 1, further comprising at least one heave compensation system connected to the hoisting cable.

26. The hoist system of claim 25, wherein the heave compensation system is selected from the group consisting of a passive heave compensator, an active heave compensator, shock absorbers, and constant tension compensators.

27. A hoist system for use in casing drilling comprising:

a. a derrick comprising
   i. a derrick inside;
   ii. a derrick outside;
   iii. a derrick top side; and
   iv. a derrick top side opening;

b. a splittable block connected to the derrick top side, having a splittable block opening aligned with the derrick topside opening;

c. a trolley comprising a trolley top side and a trolley bottom side, wherein the trolley is connected to the splittable block having a trolley opening disposed in the trolley from the trolley top side through to the trolley bottom side and aligned with the splittable block opening;

d. the hoist cable winch adapted to pull the hoist cable over the derrick top side and through the splittable block to move the trolley relative to the derrick and lift a load;

e. a wire winch adapted to pull the wireline over the derrick top side and through the openings for lifting casing drilling equipment;

f. a hoist cable passing through the splittable block and connected on one end to a hoist cable winch; and g. a wireline passing through the derrick opening, the splittable block opening, and the trolley opening and connected on a first end to a wire winch.

28. The hoist system of claim 27, wherein the derrick is secured to a floating vessel.

29. The hoist system of claim 27, wherein the derrick is located on land.

30. The hoist system of claim 27, wherein the derrick is secured to a fixed leg drilling platform.

31. The hoist system of claim 27, wherein the derrick is secured to a jack up platform.

32. The hoist system of claim 27, wherein the derrick is secured to a cantilever.

33. The hoist system of claim 27, wherein the splittable block comprises a plurality of moveable loose pulleys secured to either the movable trolley or the derrick, and a plurality of fixed pulleys secured to the derrick.

34. The hoist system of claim 33, wherein at least one loose pulley is movable between a first position, in which the loose pulley is connected to the derrick, and a second position, in which the loose pulley is connected to the movable trolley.

35. The hoist system of claim 33, further comprising a housing for containing the loose pulleys.

36. The hoist system of claim 33, further comprising at least one locking element for attaching the loose pulleys on the moveable trolley.

37. The hoist system of claim 36, further comprising a hydraulic actuation device for the at least one locking element.

38. The hoist system of claim 33, comprising between two loose pulleys and sixteen loose pulleys.

39. The hoist system of claim 33, comprising between two fixed pulleys and eight fixed pulleys.

40. The hoist system of claim 27, wherein the hoisting cable comprises a first end and a second end further wherein the first end is wound on the hoist winch and the second end is wound on a second winch.

41. The hoist system according to claim 40, wherein the hoist winch and the second winch are each driven by at least one motor.

42. The hoist system of claim 40, further comprising a first brake on said hoist winch and a second brake on said second winch.

43. The hoist system of claim 40, further comprising a control system for monitoring and driving the hoisting cable, the hoist winch, the second winch, the splittable block, and the moveable trolley.

44. The hoist system of claim 27, wherein the derrick has a height between 30 feet and 240 feet.

45. The hoist system of claim 27, wherein the derrick has a width between 3 feet and 90 feet and a length between 3 feet and 90 feet.

46. The hoist system of claim 27, further comprising a first rail and a second rail disposed on the inside of the derrick and the moveable trolley is adapted to engage the rails for movement along the axis of the derrick.

47. The hoist system of claim 43, wherein the plurality of rails are disposed on the outside of the derrick and the moveable trolley is adapted to engage the rails for movement along the axis of the derrick.

48. The hoist system of claim 27, wherein a gripper is connected to the trolley bottom side for gripping a load.

49. The hoist system of claim 27 wherein the gripper is adapted to support between 10 metric tons and 1000 metric tons.

50. The hoist system of claim 49, wherein the gripper is a hook.

51. The hoist system of claim 27, wherein the hoist cable 32 has a diameter ranging between 0.5 inches and 3 inches and is adapted to support a load of between 1 metric tons and 400 metric tons.

52. The hoist system of claim 27, further comprising at least one heave compensation system connected to the hoisting cable.

53. The hoist system of claim 52, wherein the heave compensation system is selected from the group consisting of a passive heave compensator, an active heave compensator, shock absorbers, and constant tension compensators.

54. A method for quickly modifying a hoist system from heavy load lifting to light load lifting comprising the steps:

a. using a hoist system comprising
   i. a derrick comprising
      1. a derrick inside;
      2. a derrick outside; and
      3. a derrick top side;
   ii. a splittable block connected to the derrick top side;
   iii. a hoisting cable guided through the splittable block;
   iv. a moveable trolley comprising a trolley top side and a trolley bottom side, wherein the trolley is connected to the splittable block by the hoisting cable and wherein the moveable trolley is removably secured on the derrick; and
   v. a hoist winch adapted to pull the hoisting cable over the derrick top side and through the splittable block to move the moveable trolley relative to the derrick.
b. disconnecting the heavy load from the trolley;
c. hoisting the trolley to a first position on the derrick to a disengaging position;
d. disengaging a portion of loose pulleys from the moveable trolley;
e. moving the moveable trolley to its working position;
f. picking up a lighter load; and
g. resuming the hoist system operation.

55. The method of claim 54, further comprising the step of after disengaging a portion of the loose pulleys from the moveable trolley locking the disengaged loose pulleys to the derrick.

56. A method for quickly modifying a hoist system from light load lifting to heavy load lifting comprising the steps:

a. using a hoist system comprising
   i. a derrick comprising
      1. a derrick inside;
      2. a derrick outside; and
      3. a derrick top side;
   ii. a splittable block connected to the derrick top side;
   iii. a hoisting cable guided through the splittable block;
   iv. a moveable trolley comprising a trolley top side and a trolley bottom side, wherein the trolley is connected to the splittable block by means of the hoisting cable and wherein the moveable trolley is removably secured on the derrick; and
   v. a hoist winch adapted to pull the hoisting cable over the derrick top side and through the splittable block to move the moveable trolley relative to the derrick;
b. disconnecting the light load from the trolley;
c. hoisting the moveable trolley to a first position on the derrick;
d. engaging a portion of loose pulleys with the moveable trolley;
e. picking up a heavier load; and
f. resuming the hoist system operation.

57. A method for casing drilling operations using a hoist system comprising the steps:

a. using a hoist system comprising
   i. a derrick comprising
      1. a derrick inside;
      2. a derrick outside;
      3. a derrick top side; and
      4. a derrick top side opening;
   ii. a splittable block connected to the derrick top side, having a splittable block opening aligned with the derrick topside opening;
   iii. a trolley comprising a trolley top side and a trolley bottom side, wherein the trolley top side is connected to the splittable block having a trolley opening disposed in the trolley from the trolley top side through to the trolley bottom side and aligned with the splittable block opening;

iv. the hoist cable winch adapted to pull the hoist cable over the derrick top side and through the splittable block to move the trolley relative to the derrick and lift a load;

v. a wire winch adapted to pull the wireline over the derrick top side and through the openings for lifting casing drilling equipment;

vi. a hoist cable passing through the splittable block and connected on one end to a hoist cable winch; and vii. a wireline passing through the derrick opening, the splittable block opening, and the trolley opening and connected on a first end to a wire winch;

b. connecting the drilling casing to the casing drilling equipment mounted on the trolley;

c. drilling a subsea well with the casing drilling equipment with connected drilling casing having a drill bit;

d. engaging retrieval tools to the wireline;

e. lowering the retrieval tools through the drilling casing connected to the trolley;

f. locking the retrieval tools to the drill bit using a lock;

g. disconnecting the drill bit from the drilling casing and hoist the drill bit with the wire and wire winch; and h. resuming the hoist system and drilling operations.

* * * * *